US005349340A

United States Patent [19]

Blumenthal

[11] Patent Number: 5,349,340

[45] Date of Patent: Sep. 20, 1994

[54] PORTABLE PATIENT ALERTING APPARATUS

[75] Inventor: Herbert E. Blumenthal, Cordova, Tenn.

[73] Assignee: Hunter Fan Company, Memphis, Tenn.

[21] Appl. No.: 11,185

[22] Filed: Jan. 29, 1993

[51] Int. Cl.[5] ..... G08B 7/00

[52] U.S. Cl. ..... 341/574; 340/309.4; 340/321; 340/691; 340/693

[58] Field of Search ..... 340/573, 574, 321, 286.07, 340/693, 691, 309.4, 540

[56] References Cited

U.S. PATENT DOCUMENTS

| | | | |
|---|---|---|---|
| 2,784,395 | 3/1957 | Gorby | 340/573 |
| 3,781,843 | 12/1973 | Harison et al. | 340/573 |
| 4,067,005 | 1/1978 | Levy et al. | 340/573 |
| 4,228,426 | 10/1980 | Roberts | 340/573 |
| 4,242,672 | 12/1980 | Gault | 340/573 |
| 4,731,604 | 3/1988 | Pawlowski, Jr. | 340/574 |
| 4,810,996 | 3/1989 | Glen et al. | 340/321 |
| 4,847,589 | 7/1989 | Dobbins | 340/326 |
| 4,906,972 | 3/1990 | Spencer | 340/539 |
| 4,931,772 | 6/1990 | Bechtold | 340/573 |
| 5,006,832 | 4/1991 | Beaudry | 340/574 |
| 5,029,293 | 7/1991 | Fontaille | 340/573 |
| 5,070,436 | 12/1991 | Alexander et al. | 340/321 |
| 5,124,683 | 6/1992 | Brunner | 340/323 R |

*Primary Examiner*—Glen Swann

*Attorney, Agent, or Firm*—Heiskell, Donelson, Bearman, Adams, Williams & Caldwell

[57] ABSTRACT

Mobile apparatus for attachment to a hospital bed, gurney, wheelchair, or similar transport device, has an attendant call button operable by the patient in case of an emergency, thereby activating a signal to summon an attendant. In a preferred embodiment, the signal includes both a visual indicator and an audible indicator, wherein the visual indicator is a light positioned at the distal end of a stanchion mounted to a housing, and the audible indicator is a beeper disposed within the housing. The call button is attached to the distal end of a retractable power cord and has a clip associated therewith for securing the button to the patient's clothing, bed covering, or other location convenient for the patient. Electronic circuitry contained within the housing and powered by a rechargeable battery is employed to sequentially control the operation of the light and beeper. The housing is easily detachable from the transport apparatus to facilitate recharging of the battery.

20 Claims, 2 Drawing Sheets

PORTABLE PATIENT ALERTING APPARATUS

BACKGROUND OF THE INVENTION

1. Field

The present invention relates to alerting systems for use by medical patients to notify an attendant of an emergency and, more particularly, to portable systems which move with the patient and are attached to a gurney, wheelchair, or other apparatus used to transport the patient.

2. Description of the Prior Art

The use of emergency alerting systems for medical patients has gained widespread acceptance in hospitals and some doctors' offices throughout the United States, and in fact, most of the civilized world. Virtually every hospital in the country has some sort of system in place to enable bedridden patients to alert a doctor, nurse, or other attendant in the event of an emergency. Typically, a patient call button is installed in the hospital room within reach of the patient, either affixed to the wall or bed, or attached to a flexible cord to facilitate access by the patient. Such a device is typically used to activate an indicator, located at a nurses' station, thereby signaling the need for assistance.

Patients are frequently moved about the hospital or other treatment facility via a moveable bed, gurney, wheelchair, or other transport apparatus. In such situations, the patient call button typically stays behind in the room, thereby leaving the patient with no means of signaling an attendant during transit. Oftentimes a patient will need immediate assistance during transit, but all attendants are preoccupied or temporarily distracted. Accordingly, a need has been recognized for a portable alerting system for use by patients to signal the need for medical assistance when confined to a wheelchair, gurney, or similar apparatus, and otherwise unable to attract the attention of an attendant.

BRIEF SUMMARY OF THE INVENTION

It is a principal object of this invention to provide means for alerting attendant personnel of a need, emergency, or request for assistance from a patient outside the confines of a hospital room or other monitored enclosure.

It is another object of this invention to provide such an alerting apparatus that is easily transportable, and may accompany a patient during transit from one area of a hospital or other treatment facility to another.

A further object of this invention is to provide a portable alerting apparatus that is removably securable to a hospital bed, gurney, wheelchair, or other transport apparatus.

A still further object of this invention is to provide a portable alerting apparatus that is easily accessible by a patient.

Another object of this invention is to provide an alerting apparatus having both visual and audible indicators.

Still another object is to provide such an alerting apparatus having a self-contained rechargeable power supply, which may be easily attached to a power source for recharging.

The present invention addresses the deficiencies in prior art alerting systems, and accomplishes the above and other objects. The alerting system disclosed herein comprises a transportable housing removably securable to a hospital bed, wheelchair, gurney, or other transport apparatus. Mounted atop the housing is a telescopic stanchion, having a light secured to the distal end thereof, which may be extended upwardly to increase its visibility. Mounted within the housing is a speaker or other audible alerting mechanism, both the speaker and the light being powered by a rechargeable battery also mounted within the housing. A call button is attached to a retractable electric cord secured to the housing, thereby facilitating activation of the light and speaker by a patient confined to the transport apparatus.

The above and other objects will be readily apparent to those skilled in the art upon reviewing the following detailed description, taken together with the attached drawings.

DETAILED DESCRIPTION OF THE PREFERRED EMBODIMENT

Figure 1:
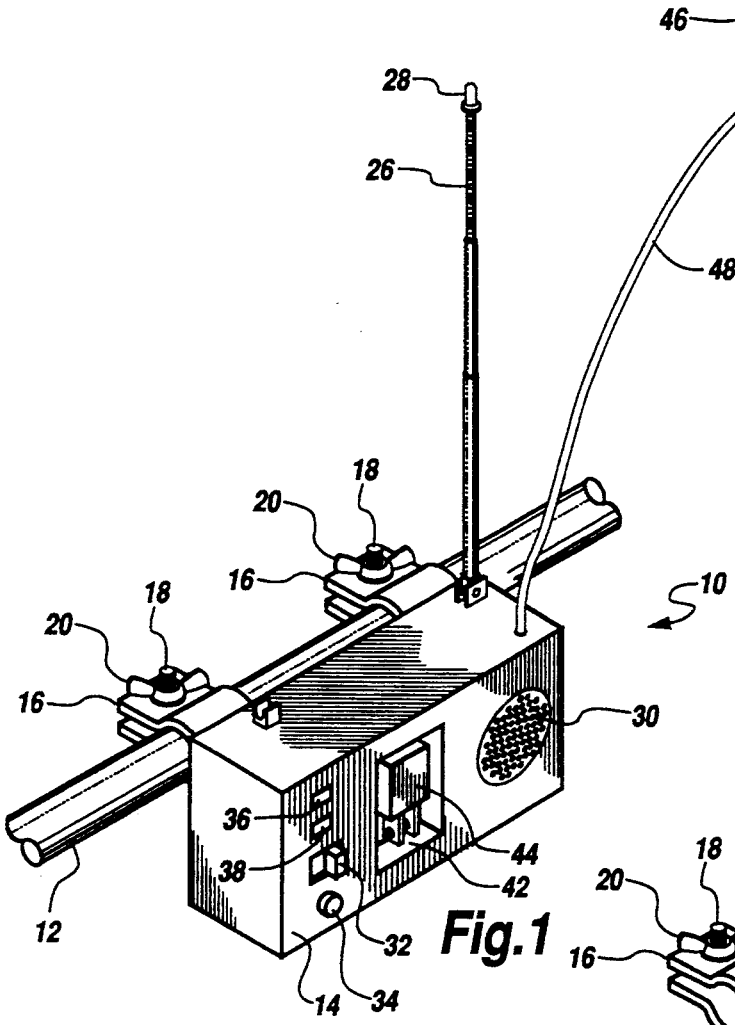
FIG. 1 is a top front perspective view of the alerting apparatus of the present invention, showing the apparatus attached to a representative rail member of a transport apparatus.

Referring initially to FIG. 1, alerting apparatus 10 is shown attached to rail member 12, which represents a typical side rail of a gurney, bed, wheelchair, or other transport apparatus commonly used in a hospital or other medical treatment facility. It will be fully understood to those skilled in the art that the principals of the present invention may be employed with virtually any type of apparatus used to move patients from one area to another.

Figure 5:
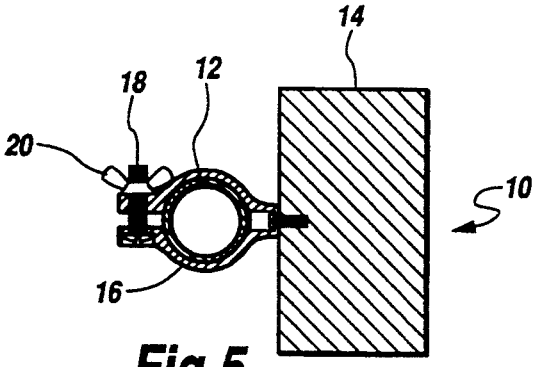
FIG. 5 is a side sectional view through the alerting apparatus illustrating the attachment of the housing to a transport apparatus.

The preferred embodiment of apparatus 10 comprises a housing 14 removably securable to rail member 12 by means of a pair of clamps 16. As best shown in FIG. 5, each clamp 16 encircles a portion of rail member 12 and is grippingly secured thereto by screw 18 and wing nut 20 in a generally conventional manner. Removal of apparatus 10 is easily accomplished by removing wing nuts 20 and opening clamps 16 sufficiently to release rail member 12.

Figure 2:
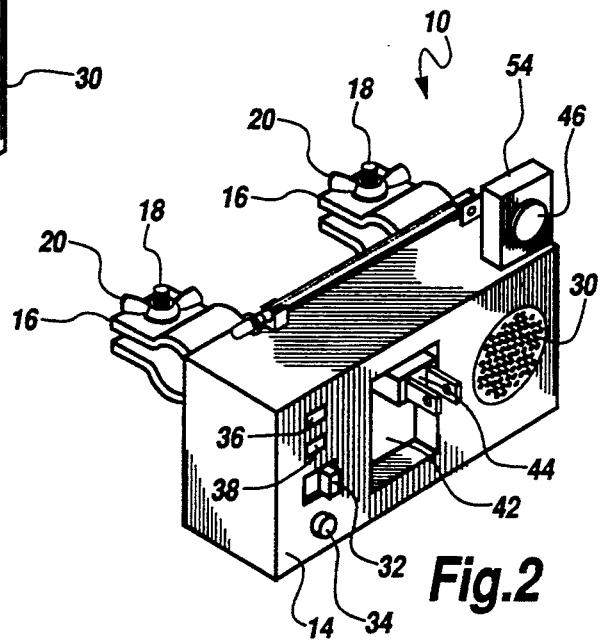
FIG. 2 is a top front perspective view similar to FIG. 1, showing the alerting apparatus removed and the recharging plug extended.

Pivotally attached to the top surface of housing 14 is stanchion 26 having light 28 operatively attached to the distal end thereof. Light 28 serves as a visible signaling indicater, the operation of which is described more fully below. Stanchion 26 preferably comprises a plurality of telescoping shafts, and may be stored in a retracted position as shown in FIG. 2, and easily moved to its fully extended position as shown in FIG. 1 when in use. In the extended position for stanchion 26 illustrated herein, light 28 will be visible to nurses, physicians, or attendants in the vicinity.

The front portion of housing 14 includes an audible alarm in the form of beeper 30 mounted therein. In the preferred embodiment shown, beeper 30 is mounted in the front portion of housing 14, as are power switch 32, attendant acknowledgement button 34, power on indicator 36, and low battery indicator 38. Those skilled in the art will readily appreciate that significant changes may be made in the configuration and placement of these various components without departing from the scope of this invention.

Figure 3:
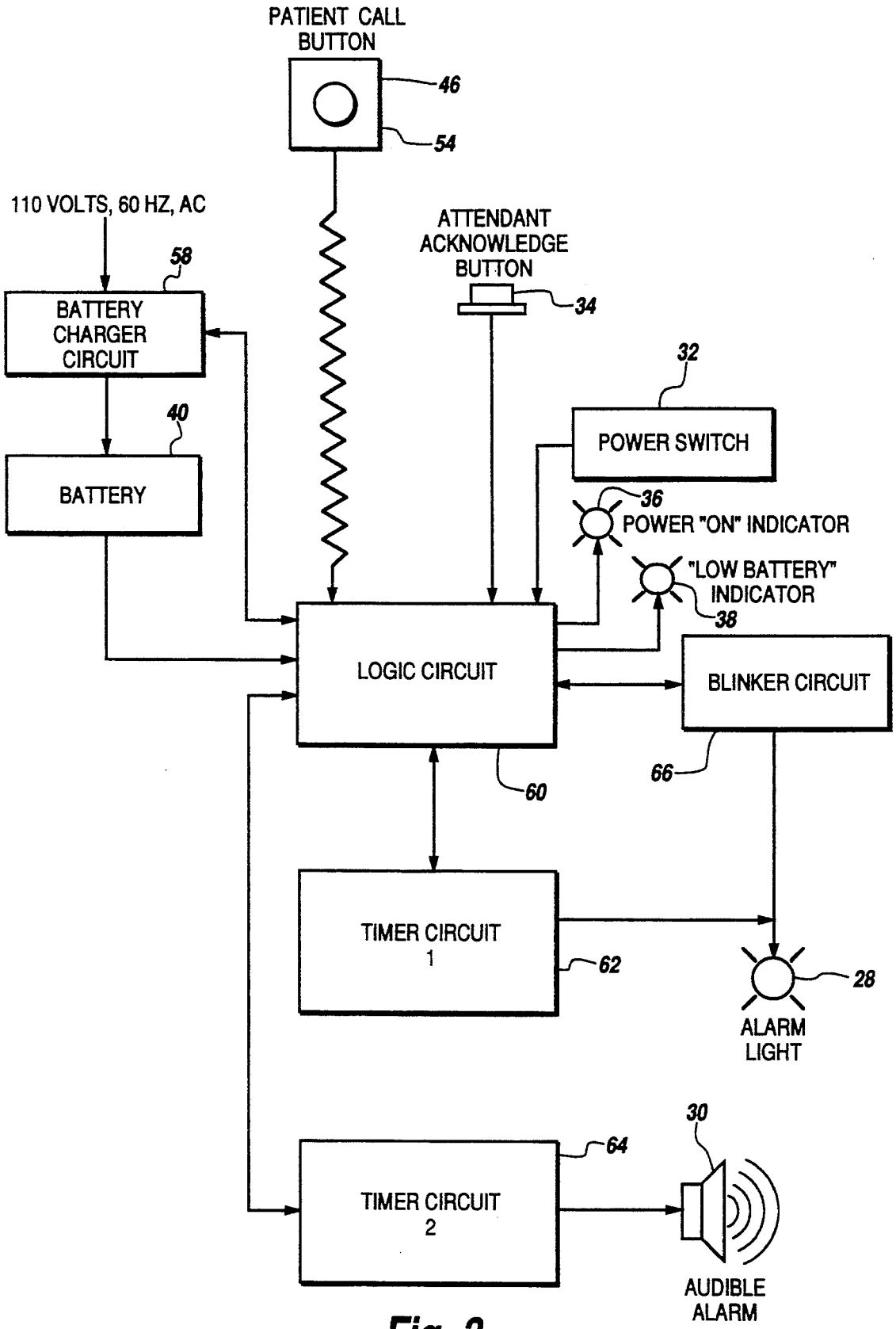
FIG. 3 is a block diagram illustrating the alerting system of the present invention.

As rechargeable battery is included within housing 14 and, being of conventional design and operation, is indicated only diagrammatically in FIG. 3 by reference numeral 40. Housing 14 includes a recess 42 with male electrical plug 44 hingedly disposed therein. Battery 40 may be easily recharged by moving plug 44 to its extended position as shown in FIG. 2 and connecting plug 44 to a wall outlet or other suitable power source. During normal usage of apparatus 10, plug 44 may be conveniently moved to its folded position within recess 42, as shown in FIG. 1.

Figure 4:
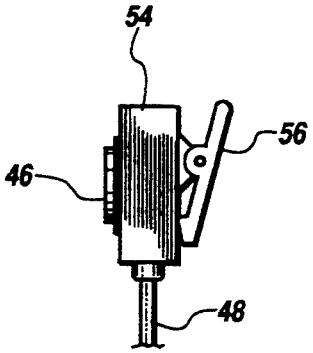
FIG. 4 is a side elevational view of the call button of the present invention.

In the preferred embodiment shown, patient call button 46 is permanently attached to the distal end of retractable power cord 48, with power cord 48 being selectively moveable between an extended position as shown in FIG. 1 and a retracted position as shown in FIG. 2. As best shown in FIG. 4, button 46 is disposed within housing 54 which includes a spring loaded clip 56 mounted on the opposite side thereof. Clip 56 may be employed to attach button 46 to a position most easily accessible to the patient, such as the patient's clothing, bed covering, etc.

The preferred operation of apparatus 10 is best explained with reference to the physical embodiment shown in FIGS. 1 and 2, in viewed together with the schematic diagram shown in FIG. 3. Initially, plug 44 is utilized to electrically connect a power source to battery charger circuit 58 which serves to charge rechargeable battery 40. Typically, the power source will comprise an alternating current receptacle, providing 110 volts and operating at 60 Hz. Actuation of power switch 32 electrically connects battery 40 with logic circuit 60 which, in turn, operates timer circuits 62 and 64 and blinker circuit 66 upon actuation of call button 46. It is to be understood that the electrical components disclosed herein are purely conventional and are contained within housing 14 in a conventional manner.

As will be clear to those skilled in the art, apparatus 10 uniquely serves to provide both a visual indicator (light 28) and a audible indicator (beeper 30) to signal the emergency needs of a medical patient. Preferably, actuation of call button 46 by the patient initially activates blinker circuit 66 which causes light 28 to blink on and off in a predetermined sequence. After a predetermined time period as monitored by timer circuit 62, light 28 is automatically switched to remain on in a steady condition. After a second predetermined time period as monitored by timer circuit 64, alarm 30 is activated to provide an audible signal for summoning an attendant. The operation of light 28 and beeper 30 may be interrupted at any point in the above described sequence upon actuation of attendant acknowledgement button 34 by an attendant, thereby resetting logic circuit 60 which is maintained in an operable condition.

Power on indicator 36 is preferably a light omitting diode or other readily visible device which is activated whenever power switch 32 is moved to the on position. Similarly, low battery indicator 38 is preferably a light omitting diode or other readily visible device which is automatically activated by logic circuit 60 when the charge held by battery 40 becomes unacceptably low. Upon activation of low battery indicator 38, housing 14 may be disengaged from rail member 12 by removing wing nuts 20 from screws 18 and removing clamps 16 from rail 12, and plug 44 engaged with a power source to recharge battery 40.

While the principals of a portable patient alerting system have been made clear from the drawings and specification provided herein, it will be appreciated by those skilled in the art that many variations may be contemplated without deviating from the scope of this invention. It should also be understood that this specification is by illustration only and that the invention is not necessarily limited to the specific embodiment disclosed herein, since alternative embodiments and operating techniques will become apparent to those skilled in the art in view of this disclosure. Accordingly, modifications are contemplated which can be made without departing from the spirit and scope of the described invention.

What is claimed is:

1. A portable alerting device for use by medical patients confined to a gurney, wheelchair, or other transport apparatus, comprising:

a housing, removably securable to the transport apparatus, having a plurality of side portions and a top portion;

signalling means mounted to said housing; and actuating means, selectively operable by the patient, for controlling the operation of said signalling means in response to input from the patient.

2. An alerting device as set forth in claim 1, wherein:

said signalling means comprises both a visual indicator and an audible indicator; and said actuating means controls the operation of both said visual and audible indicators in response to a single input effort by the patient.

3. An alerting device as set forth in claim 1, wherein:

said signalling means comprise electrical components; and said actuating means comprise a source of electric power, electronic circuitry operatively connected to said power source, and switch means operatively connected to said circuitry, selectively moveable by the patient between on and off positions, said switch means being operative when in said on position to establish an electrical connection between said power supply and said signalling means thereby activating said signalling means.

4. An alerting device as set forth in claim 3, wherein:

said signalling means comprise a light and a beeper.

5. An alerting device as set forth in claim 4, further comprising:

a stanchion mounted to said top portion of said housing, selectively moveable between lowered and raised positions, having a proximate end pivotally secured to said housing and a distal end, said light being mounted on said distal end whereby said light is maintained in a vertically spaced relation to said housing when said stanchion is in said raised position.

6. An alerting device as set forth in claim 3, wherein:

said switch means comprise a button switch, normally biased in its off position.

7. An alerting device as set forth in claim 3, wherein;

said power source comprises a rechargeable battery.

8. An alerting device as set forth in claim 7, further comprising:

plug means disposed in one of said side portions of said housing, electrically communicative with said battery and engageable with an electrical outlet to effect recharging of said battery.

9. An alerting device as set forth in claim 8, wherein:

said plug means includes a male plug member pivotable between extended and retracted positions, said plug member being suitably disposed to engage said electrical outlet when in said extended position and substantially flush with said side portion when in said retracted position.

10. An alerting device as set forth in claim 7, further comprising:

a warning light for indicating a low charge for said battery.

11. An alerting device as set forth in claim 3, wherein said actuating means further comprise:

an extendable electrical cord, having a first end electrically connected to said circuitry and a second end operatively connected to said switch means; and a retaining mechanism associated with said switch means for securing said switch means at a location remote from said housing and readily accessible to the patient.

12. An alerting device as set forth in claim 3, wherein:

said signalling means further comprise a light and a beeper; and said circuitry includes a timer and a reset switch, said reset switch being operative to de-activate said signalling means, whereby;

upon activation of said signalling means, said light is initially activated for a preselected time period, after which said beeper is automatically activated provided that said reset switch is not operated during said preselected time period.

13. A portable alerting device for use by medical patients confined to a gurney, wheelchair, or other transport apparatus, comprising:

a housing, removably securable to the transport apparatus, having a plurality of side portions and a top portion;

signalling means mounted to said housing, comprising electronically activated visual and audible indicators; and actuating means, selectively operable by the patient, for controlling the operation of said signalling means in response to input from the patient, said actuating means comprising a battery for providing electrical power;

electronic circuitry connected to said battery for controlling the operation of said visual and audible indicators; and a switch operatively connected to said circuitry and selectively moveable by the patient from an off position to an on position, said switch serving to activate said visual and audible indicators when moved to said on position by establishing an electrical connection between said circuitry and said indicators; and a reset switch, manually operable to de-activate said visual and audible indicators.

14. An alerting device as set forth in claim 13, wherein said actuating means further comprise:

a retractable electrical cord interconnected between said switch and said circuitry, having a proximate end operatively connected to said actuating means and a distal end attached to said switch; and a fastening device associated with said switch for attaching said switch to a location remote from said housing within reach of said patient.

15. An alerting device as set forth in claim 13, wherein said actuating means further comprise:

a timer included in said circuitry for initially activating said visual indicator for a predetermined time period prior to activating said audible indicator.

16. An alerting device as set forth in claim 15, wherein:

said timer is programmable, and is pre-programmed to sequentially activate said visual and audible indicators in three discrete stages, wherein said first stage corresponds to said visual indicator operating in a pulsating manner, said audible indicator being inactive, said second stage corresponds to said visual indicator operating in a continuous manner, said audible indicator being inactive, and said third stage corresponds to said visual indicator operating in a continuous manner and said audible indicator operating in a pulsating manner.

17. An alerting device as set forth in claim 13, further comprising:

a stanchion having a proximate end pivotally attached to said housing and a distal end in spaced relation thereto, said visual indicator being disposed on said distal end, said stanchion being selectively moveable between first and second positions, wherein said visual indicator is generally adjacent said housing with said stanchion in said first position, and maintained at a distance from said housing with said stanchion in said second position.

18. An alerting device as set forth in claim 17, wherein:

said stanchion is telescopically extendable, whereby the distance between said visual indicator and said housing when said stanchion is in said second position may be increased.

19. An alerting device as set forth in claim 13, wherein:

said battery is rechargeable, and;

said housing includes recharge means disposed therein, said recharge means comprising a plug adapted to engage a suitable source of electricity, said plug being pivotable between an extended position suitable for engaging said source of electricity and a folded position.

20. An alerting device as set forth in claim 13, wherein:

said visual indicator comprises a light; and said audible indicator comprises a beeper.

* * * * *

UNITED STATES PATENT AND TRADEMARK OFFICE

CERTIFICATE OF CORRECTION

PATENT NO. : 5,349,340

DATED : September 20, 1994

INVENTOR(S) : BLUMENTHAL, HERBERT E.

It is certified that error appears in the above-identified patent and that said Letters Patent is hereby corrected as shown below:

On the title page, item [73] delete "Hunter Fan Company, Memphis, Tennessee" as the assignee.

Signed and Sealed this

Twenty-eight Day of February, 1995

*Attest:*

*Attesting Officer*

BRUCE LEHMAN

*Commissioner of Patents and Trademarks*